US006079487A

United States Patent [19]

Lopes et al.

[11] Patent Number: 6,079,487

[45] Date of Patent: Jun. 27, 2000

[54] HEAT EXCHANGER

[75] Inventors: Luis Antonio Diemer Lopes, Joinville-SC; Jurandir Itizo Yanagihara, São Paulo-SP, both of Brazil

[73] Assignee: Multibras S/A Eletrodomesticos, Sao Paulo-SP, Brazil

[21] Appl. No.: 09/261,839

[22] Filed: Mar. 3, 1999

[30] Foreign Application Priority Data

Mar. 30, 1998 [BR] Brazil ..... 9801850

[51] Int. Cl.[7] ..... F28D 1/04

[52] U.S. Cl. ..... 165/151; 165/DIG. 502; 165/DIG. 503

[58] Field of Search ..... 165/151, 182

[56] References Cited

U.S. PATENT DOCUMENTS 4,787,442 11/1988 Esformes ..... 165/151
4,997,036 3/1991 Schulze et al. ..... 165/182
5,553,663 9/1996 Yu ..... 165/151
5,685,367 11/1997 Jun ..... 165/151
5,848,638 12/1998 Kim ..... 165/151

FOREIGN PATENT DOCUMENTS 61-243289 10/1986 Japan ..... 165/151

*Primary Examiner*—Allen Flanigan
*Attorney, Agent, or Firm*—Darby & Darby

[57] ABSTRACT

A heat exchanger of the fin type with a forced air flow, comprising: a thermal exchange tube (10) having a plurality of mutually parallel rectilinear portions (11); and a plurality of flat fins (20), which are parallel to the direction of the forced air flow, spaced apart from each other and provided with openings (21) for the passage of said rectilinear portions (11), a pair of air flow deflectors (30) being provided downstream at least part of said rectilinear portions (11), each flat fin (20) having, from one of the faces thereof and laterally to the openings (21), alignments of fin projections (22) associated with respective fin windows (23) for the passage of the deflected forced air flow.

6 Claims, 2 Drawing Sheets

HEAT EXCHANGER

FIELD OF THE INVENTION

The present invention refers to a heat exchanger of the fin type, which is usually used in refrigeration appliances, such as air conditioners.

BACKGROUND OF THE INVENTION

In the refrigeration system of the refrigeration appliances, the gas under pressure which is pumped by the compressor is conducted to a heat exchanger (of the tube-wire or fin type), where the gas exchanges energy and suffers a change of state.

Generally, the fin type construction, as used for example in air conditioners, comprises a thermal exchange tube, which is in the form of parallel rectilinear portions communicating with each other by curved end portions, and in which circulates the refrigerant fluid. The thermal exchange tube is mounted in a structure formed by a plurality of flat plates or fins, which are parallel to each other and to the direction of a forced air flow, and which are orthogonal to the longitudinal axis of the rectilinear portions of the thermal exchange tube, said portions being disposed in rows or arrangements of the quincunx type, for example.

The provision of flat fins aims at increasing the area of thermal exchange with the thermal exchange gas, usually air, which flows between these fins. In order to improve the heat exchange between the air and the refrigerant fluid inside the thermal exchange tube, the flat fins may have constructive details on the surface thereof, usually in the form of fin projections stamped on the fin plate itself.

The thermal exchange mechanism in the case of the fins provided with fin projections results from phenomena, such as the successive interruptions and restartings of the limit layer, simulating a condition of constant heat input, with less thickness of the limit layer and a self-sustained oscillatory flow above a determined number of Reynolds.

DISCLOSURE OF THE INVENTION

Thus, it is an objective of the present invention to provide a heat exchanger of the fin type, which presents an improvement in its thermal exchange capacity.

Another objective of the present invention is to provide a more compact heat exchanger, without impairing the actuation thereof in the thermal exchange between the air and the refrigerant fluid inside the thermal exchange tube.

These and other objectives are attained by a heat exchanger of the fin type with forced air flow, comprising: a thermal exchange tube, having a plurality of mutually parallel rectilinear portions; and a plurality of flat fins, which are parallel to the direction of the forced air flow, spaced apart from each other and provided with openings for the passage of said rectilinear portions, each flat fin having, from one of the faces thereof and laterally to the openings, alignments of fin projections associated with respective fin windows for the passage of the deflected forced air flow, said heat exchanger comprising at least one plurality of pairs of deflectors, at least one pair of deflectors being provided between the alignments of fin projections and downstream a respective opening and projecting from at least one of the faces of at least part of the flat fins, in a diverging arrangement, in order to laterally deflect and whirl the forced air flow.

BRIEF DESCRIPTION OF THE DRAWINGS

The invention will be described below, with reference to the attached drawings, in which.

BEST MODE OF CARRYING OUT THE INVENTION

The present invention will be described in relation to a heat exchanger of the fin type, which is for example used in air conditioners and through which the air flow is forced to pass parallely to the fins of said heat exchanger.

Figure 1:
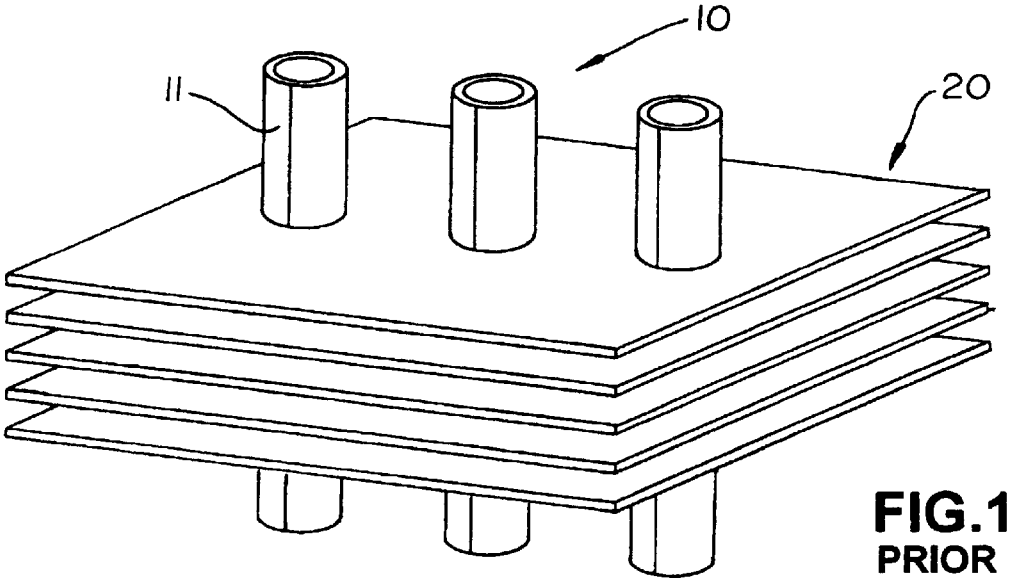
FIG.1 PRIOR ART
FIG. 1 illustrates, schematically and in a perspective view, a heat exchanger of the fin type, mounted to a plurality of fins constructed according to the prior art.
Figure 2:
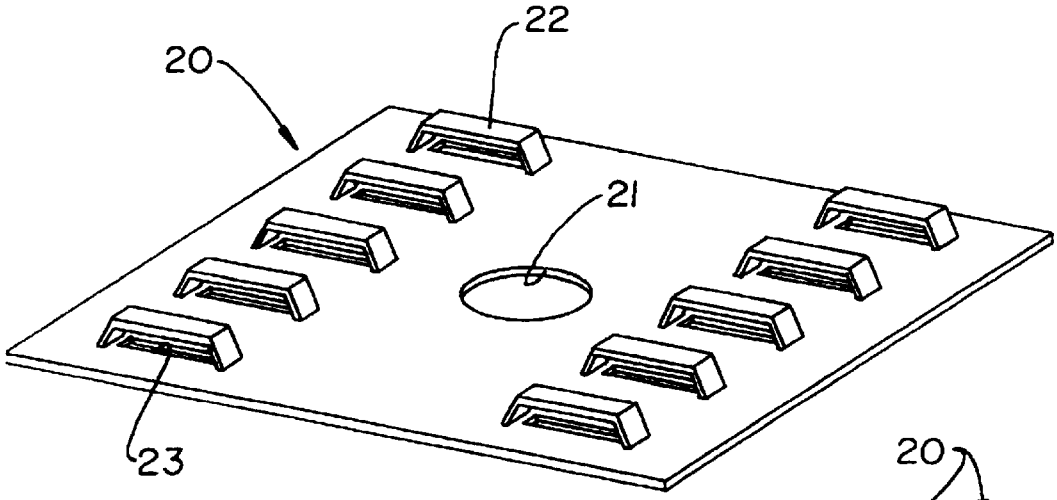
FIG.2 PRIOR ART
FIG. 2 illustrates, schematically and in a perspective view, part of a fin provided with alignments of fin projections intercalated with openings in said fin, for the passage of the thermal exchange tube, indicating the air flow direction.

According to the illustrations of FIGS. 1 and 2, the prior art heat exchanger has a thermal exchange tube 10, with rectilinear portions 11 interconnected by curved tube portions, not illustrated, and a plurality of flat fins 20, each provided with at least one longitudinal alignment of openings 21, each opening 21 receiving and mounting, orthogonally, a respective rectilinear portion 11 of a thermal exchange tube 10. The flat fins of the plurality of flat fins 20 are provided parallel to each other and to the direction of the forced air flow through the heat exchanger, and mutually spaced from each other by a previously established distance, in order to allow a determined air flow, for thermal exchange, in the volume generated by said spacing.

In the illustrated conventional constructions, each flat fin 20 has, along the larger extension thereof, at least two longitudinal alignments of openings 21, which are parallel to each other and to the longitudinal axis of the flat fins 20, the openings 21 being provided, in each alignment, angularly offset from the openings of an adjacent alignment, the openings 21 of each longitudinal alignment being equally spaced from each other.

In one of the prior art constructions (see FIG. 2), each flat fin 20 has, laterally to the openings 21, alignments of fin projections 22, each fin projection 22 being associated with a respective fin window 23, which is defined in the flat fin 20, for the passage of the forced air flow deflected by the respective fin projections 22, each plurality of fin projections 22 occupying a certain fin extension, which is limited, on one side, by one of the parts defined by an opening 21 from an adjacent alignment of openings and, on the other side, by an adjacent longitudinal edge of the flat fin 20 in which said plurality of fin projections 22 is provided.

Figure 3:
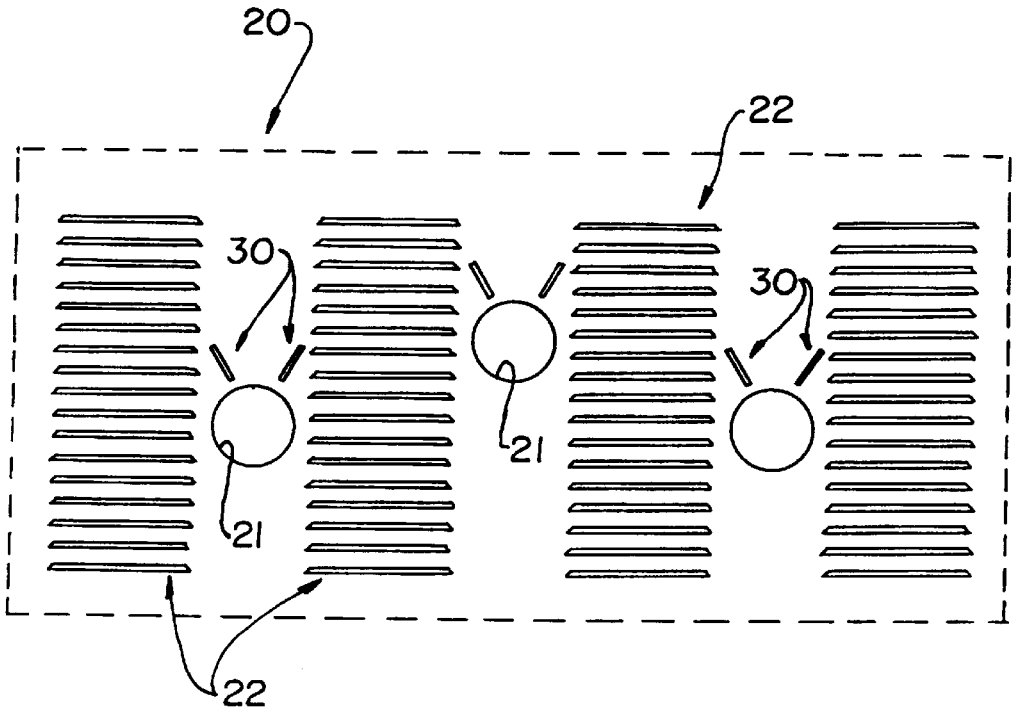
FIG. 3 illustrates, schematically, an upper plan view of part of a fin constructed according to the present invention.

According to this construction, part of the surface of the flat fins 20, which is adjacent to each opening 21, is not fully used and it is not provided with means for intensifying the thermal exchange, for example in the form of projections, as a function of the difficulty for providing said projections in this region and also due to the risk of impairing the rigidity of the flat fin, in case said projections are provided thereon. According to the illustrations of FIGS. 3-5, the heat exchanger of the present invention comprises, in at least part of the plurality of flat fins 20 provided with fin projections 22, at least one plurality of pairs of deflectors 30 with for example a triangular profile, which distribute the refrigerant fluid flow passing between each two consecutive flat fins 20, laterally deflecting and whirling said forced air flow. According to the present invention, at least part of the flat fins 20 has, downstream at least part of the openings 21 thereof, at least one pair of deflectors 30, projecting from at least one of the opposite faces of the flat fin 20 in which said pairs of deflectors 30 are provided.

According to the illustrations, each deflector 30 of a pair of deflectors 30 is provided from the same face of the respective flat fin 20, downstream a respective opening 21 thereon, in order to diverge the air flow which surrounds the rectilinear portion 11 provided in the respective opening 21, laterally deflecting and whirling the air flow, which is forced to pass through the heat exchanger.

Though not illustrated, the improvement of thermal exchange obtained with a heat exchanger according to the present invention may be achieved by a construction in which at least part of the flat fins 20 has pairs of deflectors provided from at least one of the opposite faces thereof, said pairs of deflectors 30 being or not associated with the same rectilinear portion 11.

Each deflector 30 is mounted to a flat fin 20, which is for example incorporated into or otherwise affixed to said flat fin, by means of a lower edge 31 seated onto the face of the flat fin 20 from which it is provided, said deflector 30 having a front leading edge 32, which is for example rectilinear and rearwardly inclined in relation to the air flow direction, and projecting from said face of the flat fin 20. In the illustrated construction, each deflector 30 has a triangular profile, with a rear edge 33 orthogonal to the flat fin 20 whereto it is affixed.

Each deflector 30 further has a front face 34, which is turned to the direction of the incoming air flow and which also causes a change in the displacement direction of said air, deflecting a respective portion of the forced air flow between an opening 21 and an adjacent alignment of fin projections 22.

Figure 5:
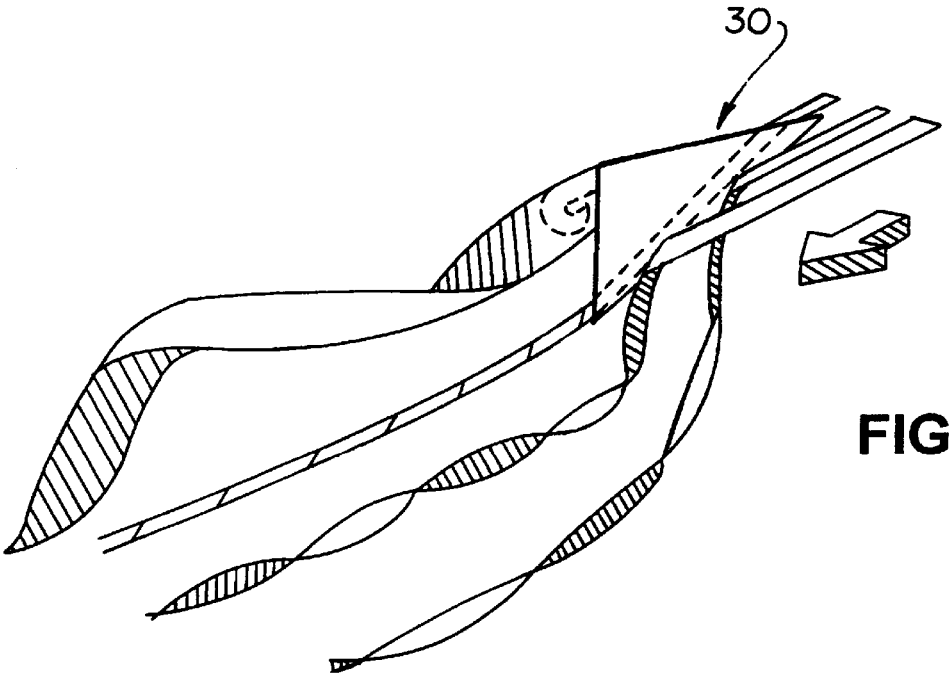
FIG. 5 illustrates, schematically, the alterations in the air flow direction provoked when the air passes by a deflector.

The deflectors 30 of each pair of deflectors 30 determine, to the air flow, different types of vortexes, as a function of their specific construction, which whirl the air passing through each thermal exchange tube associated with at least one pair of deflectors 30. One of these vortexes, illustrated in FIG. 5, is denominated longitudinal vortex, which is aligned with the main direction of the viscous displacement of said fluid flow and which is the main responsible for the increase of thermal exchange.

The main mechanism for enhancing the heat transfer in a pair of deflectors 30 by means of longitudinal vortexes is the increase in the laminar transportation of energy, due to the reduction of the limit layer in the region between the deflectors. This region has a low whirling intensity, due to the elimination of the flowing instabilities. This reduction of the instabilities is caused by the strong downward vortical movement between the deflectors.

Among the vortexes generated by the deflectors 30 there are further provided the main vortex, resulting from the separation of the flow at the front leading edge 32 of the deflectors 30 (and which causes a whirl in the air flow, due to the low pressure at the rear side of the deflector 30), vortexes with a horse-shoe shape, which are formed between the rear face of each deflector 30 and the flat fin 20, and also secondary vortexes, which are induced between the rear face of the deflector 30 and the flat fin 20, resulting from the reconduction of the flow close to said face and which are caused by the low pressure in the region behind the deflector 30.

The shape of each deflector 30, as well as the angular positioning of the front leading edge 32 of each deflector 30 in relation to the flat fin 20, the distance in relation to the respective rectilinear portion 11 and the distance between the deflectors 30 of each pair of deflectors are defined in the project and as a function of a maximization of the desired thermal exchange effects and depend, among other parameters, on the conditions in which the heat exchanger is used and its geometry (flow regime, spacing between fins, etc.).

Figure 4:
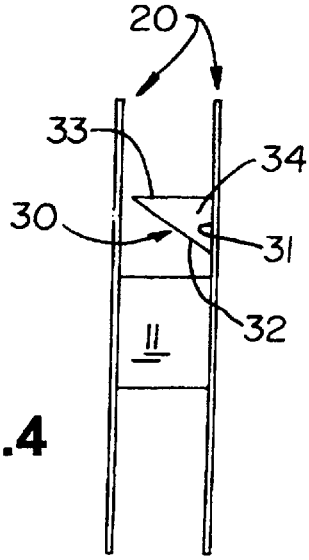
FIG. 4 illustrates, schematically and in a partial lateral view, two consecutive fins constructed according to the present invention.

According to the illustration in FIG. 4, the height of the deflectors 30 is defined so as to be, at maximum, slightly lower than the distance between two adjacent flat fins 20, in order to allow the formation of the main vortex adjacent to each deflector end edge spaced from the base portion thereof affixed to the flat fin 20.

The angle by which each deflector 30 is disposed in relation to the direction of the air flow displacement is calculated so as to occupy the maximum of the free area which is not provided with the fin projections 22. The angular positioning of each deflector 30 determines the actuation of the front face 34 thereof on the passing air flow and, consequently, on the directioning of the induced and of the corner vortexes, which lead the air flow to the region of the fin projections.

With these constructions, for the same extension of the prior art thermal exchange tube, it is possible to obtain a heat exchanger with a smaller longitudinal extension and with higher efficiency than those of the prior art, or also to improve said efficiency, by using the whole extension of the prior art heat exchanger, without requiring any dimensional alterations in the equipment to which it is mounted.

The heat exchanger described herein allows to improve the optimization in the thermal exchange area of the flat fins 20 and, consequently, the thermal exchange between the air flowing between said flat fins 20 and the refrigerant fluid flowing down the thermal exchange tube 10, since it makes possible to use, for thermal exchange, the regions adjacent to each opening 21 of each flat fin 20, where it is not possible to provide fin projections 22, due to constructive limitations and to the reduction in the fin resistance. Thus, the heat exchanger of the present invention allows to obtain the advantages of: higher thermal exchange efficiency by area unit of the heat exchanger, increasing the energetic efficiency of the system; the use of more compact heat exchangers for the same thermal power, allowing to save material in the production of said heat exchangers, as a result from a better usage of the thermal exchange surfaces.

What is claimed is:

1. A heat exchanger of the fin type to be used with a forced air flow, comprising:

a thermal exchange tube having a plurality of mutually parallel rectilinear portions;

a plurality of flat fins which are parallel to the direction of the forced air flow, spaced apart from each other and provided with openings for the passage of said rectilinear portions, each flat fin having, from one of the faces thereof and laterally to the openings, alignments of fin projections associated with respective fin windows for the passage of the deflected forced air flow;

at least one plurality of pairs of deflectors, at least one pair of deflectors on a face of a flat fin between the alignments of fin projections and downstream of a respective opening and projecting in a diverging arrangement relative to the central axis of a said rectilinear portion to laterally deflect and whirl the forced air flow, each deflector having a height which is slightly less than the distance between the flat fin to which it is affixed and an adjacent flat fin.

2. A heat exchanger, as in claim 1, has a front edge which is constantly in communication with the air flow passing around the said rectilinear portion of the thermal exchange tube with which the deflector is associated.

3. A heat exchanger, as in claim 2, wherein each deflector has a front face which deflects a respective portion of the forced air flow passing between an opening and an adjacent alignment of said fin projections.

4. A heat exchanger, as in claim 1, wherein each deflector has a triangular profile with a front leading edge which is rectilinear and rearwardly inclined in relation to the direction of the forced air flow, and a rear edge, which is orthogonal to the flat fin.

5. A heat exchanger as in claim 1 wherein each said deflector has a triangular profile with the base on said flat fin, the larger leg facing the air flow path.

6. A heat exchanger as in claim 5 wherein the angle of divergence between a pair of said deflectors is in the range of from about 45° to about 50°.

* * * * *